US006390573B1

(12) United States Patent
Wang

(10) Patent No.: US 6,390,573 B1
(45) Date of Patent: May 21, 2002

(54) WARDROBE INTERNAL CLOTHES CABINET

(76) Inventor: Wen-Tsan Wang, PO Box 82-144, Taipei (TW)

( * ) Notice: Subject to any disclaimer, the term of this patent is extended or adjusted under 35 U.S.C. 154(b) by 0 days.

(21) Appl. No.: 09/860,537

(22) Filed: May 21, 2001

(51) Int. Cl.[7] ..... A47B 47/00
(52) U.S. Cl. ..... 312/6; 108/149
(58) Field of Search ..... 312/4, 5, 6, 107, 312/108, 111, 245, 257.1; 108/149, 164; 211/113, 118, 194

(56) References Cited

U.S. PATENT DOCUMENTS 1,678,415 A * 7/1928 Ahles ..... 312/6
2,639,819 A * 5/1953 Marks ..... 108/149 X
2,845,185 A * 7/1958 Winderweedle, Jr. ... 108/149 X
4,382,640 A * 5/1983 Kashden ..... 312/5
5,713,646 A * 2/1998 Wang ..... 312/6 X
6,142,589 A * 11/2000 Wang ..... 312/6

* cited by examiner

*Primary Examiner*—James O. Hansen
(74) *Attorney, Agent, or Firm*—A & J

(57) ABSTRACT

A clothes cabinet includes a plurality of stretchers respectively fastened to the top panel, bottom panel and intermediate partition panels of the flexible cabinet body thereof to support the cabinet body in shape, each of the top panel, bottom panel and intermediate partition panels having two pockets at two sides of the respective bottom sidewall adapted to receive the respective stretcher, and at least one holding down strip suspending between the pockets and adapted to hold down the respective stretcher in the pockets.

1 Claim, 5 Drawing Sheets

WARDROBE INTERNAL CLOTHES CABINET

BACKGROUND OF THE INVENTION

The present invention relates to wardrobes, and more specifically to a clothes cabinet for use in a wardrobe, which comprises a collapsible cabinet body, a plurality of stretchers shaped like a rectangular open frame and respectively fastened to the top panel, bottom panel and intermediate partition panels of the cabinet body to support the cabinet body in shape, and fastening strips with hook and loop materials for securing the cabinet body to a transverse rod member in a wardrobe.

A variety of collapsible clothes cabinets have been disclosed for use in wardrobes to hold classified clothes, and have appeared on the market. These collapsible clothes cabinets are commonly comprised of a flexible cabinet body made of plastic sheet material or canvass, a frame structure formed of a metal wire rod and mounted in the cabinet body to support the cabinet body in shape, and a hook fastened to the frame structure and extended out of the top side of the cabinet body for hanging on a transverse rod member in a wardrobe. A clothes cabinet of this design is complicated and expensive. When carrying a heavy load, the frame structure tends to be forced to deform. Further, conventional clothes cabinets are separately used. The user cannot connect multiple clothes cabinets into a series to hold more storage items.

SUMMARY OF THE INVENTION

The present invention has been accomplished to provide a wardrobe internal clothes cabinet, which eliminates the aforesaid drawbacks. It is one object of the present invention to provide a wardrobe internal clothes cabinet, which can be conveniently hung on a transverse rob member inside a wardrobe. It is another object of the present invention to provide a wardrobe internal clothes cabinet, which enables multiple wardrobe internal clothes cabinets to be conveniently connected in series. It is still another object of the present invention to provide a wardrobe internal clothes cabinet, which is collapsible. It is still another object of the present invention to provide a wardrobe internal clothes cabinet, which is durable in use. To achieve these and other objects of the present invention and according to one aspect of the present invention, the wardrobe internal clothes cabinet comprises a flexible cabinet body, the flexible cabinet body comprising a top panel, a bottom panel, and a plurality of partition panels spaced between the top panel and the bottom panel, and a plurality of stretchers shaped like a rectangular open frame and respectively fastened to the top panel, bottom panel and partition panels of the flexible cabinet body to support the cabinet body in shape, the top panel, bottom panel and partition panels each having two pockets at two sides of the respective bottom sidewall adapted to receive the respective stretcher, and at least one holding down strip suspending between the pockets and adapted to hold down the respective stretcher in the pockets. According to another aspect of the present invention, the top panel has two holes at two sides, and two fastening devices are respectively inserted through the stretcher and extended out of the holes of the top panel for securing the wardrobe internal clothes panel to a transverse rod member in a wardrobe or the stretcher at the bottom sidewall of the bottom panel of another wardrobe internal clothes cabinet.

DETAILED DESCRIPTION OF THE PREFERRED EMBODIMENT

Figure 1:
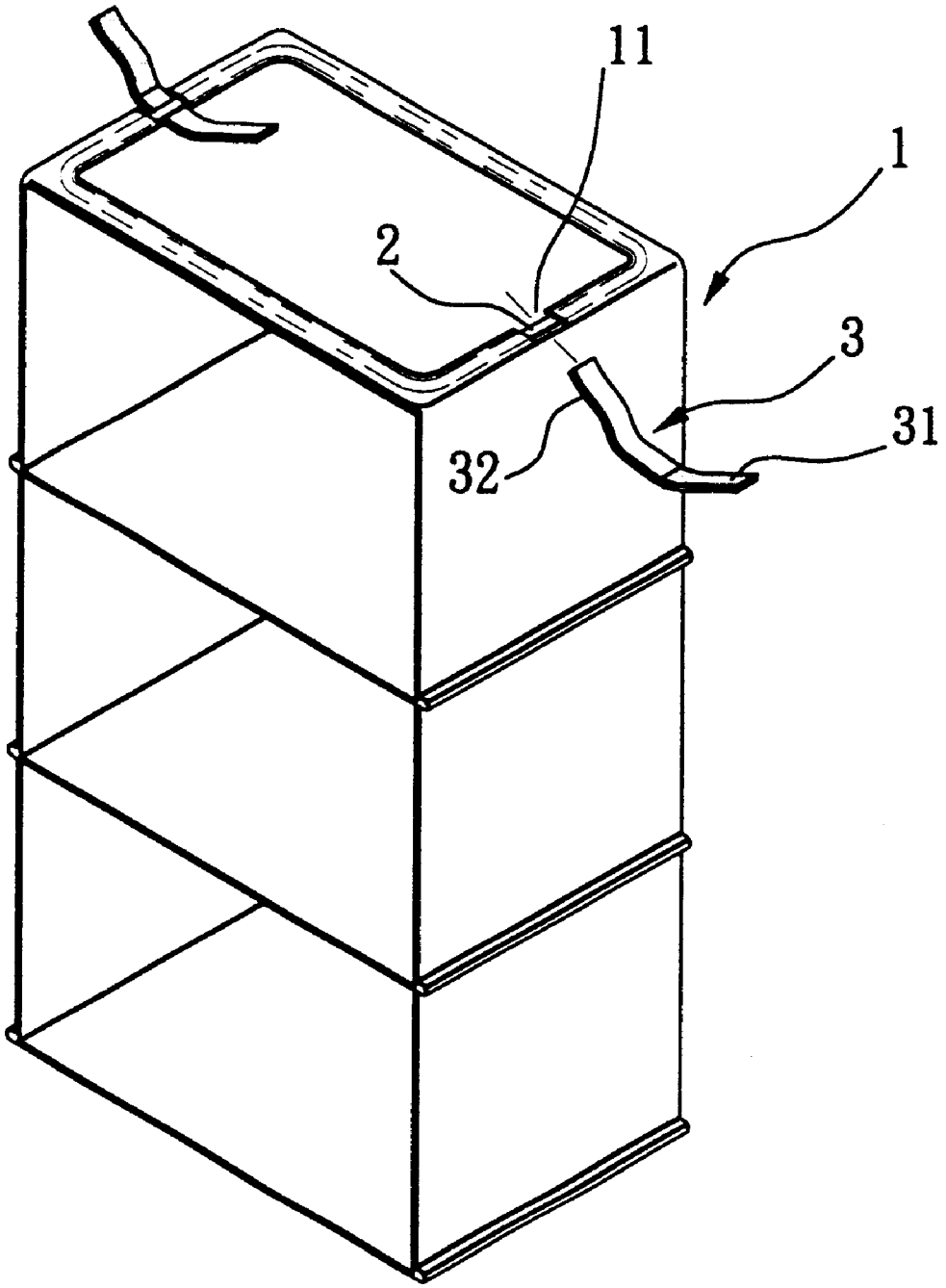
FIG. 1 is a perspective view of a wardrobe internal clothes cabinet according to the present invention.
Figure 2:
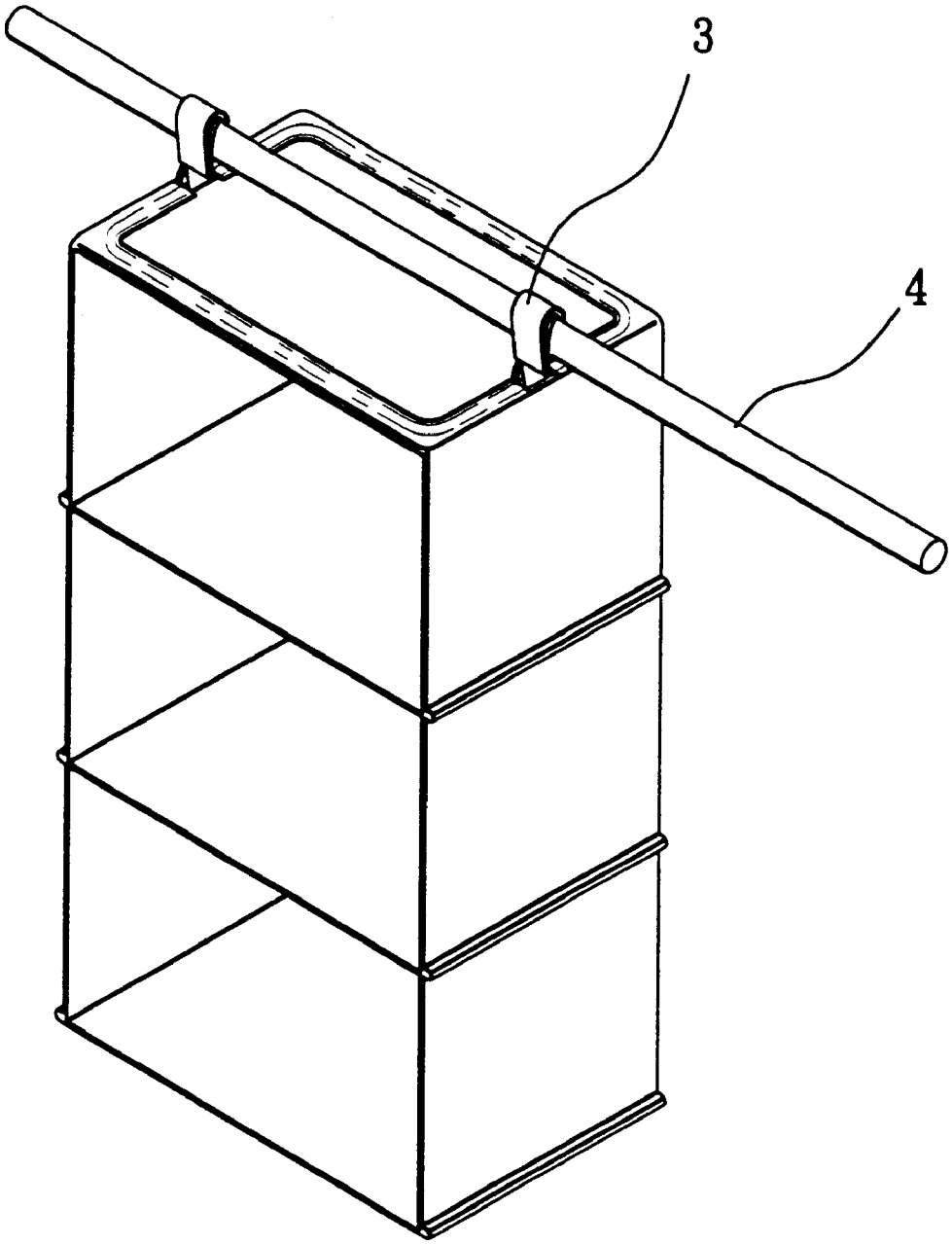
FIG. 2 shows the wardrobe internal clothes cabinet fastened to a transverse rod member according to the present invention.

Referring to FIGS. 1 and 2, a wardrobe internal clothes cabinet 1 is shown comprising two holes 11 through the top panel thereof at two sides, a stretcher 2 fixedly fastened to the bottom sidewall of the top panel and extending over the holes 11, and two fastening devices 3 respectively fastened to the stretcher 2 outside the holes 11 and adapted to secure the wardrobe internal clothes cabinet 1 to a transverse rod 4 inside the wardrobe (not shown). The fastening devices 3 can be cord members, loops, straps, or the like. According to the present embodiment, the fastening devices 3 are flexible straps each having a fixed tape of loop material 31 and a fixed tape of hook material 32 respectively disposed at two distal ends thereof. When inserted through the stretcher 2 in the holes 11 of the top panel of the wardrobe internal clothes cabinet 1, the fixed tape of loop material 31 of the flexible strap of each fastening device 3 is fastened to the corresponding fixed tape of hook material 32, enabling each fastening device 3 to be secured to the wardrobe internal clothes cabinet 1.

Figure 5:
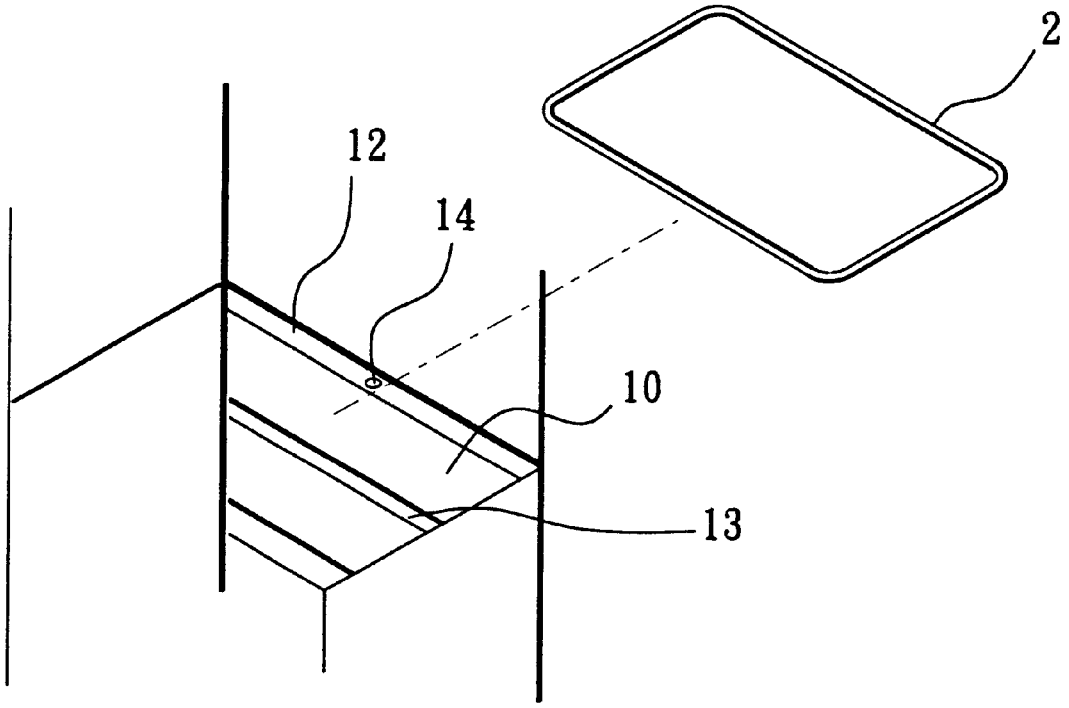
FIG. 5 illustrates the installation of one stretcher in one partition wall of the wardrobe internal clothes cabinet according to the present invention.

Referring to FIG. 5, each partition panel 10 of the wardrobe internal clothes cabinet 1 comprises two pockets 12 disposed in parallel along two sides of the bottom sidewall of the respective partition panel 10 and facing each other and a holding down strip 13 spaced between the pockets 12, and a respective stretcher 2 is fastened to the pockets 12 to support the partition panel 10 in shape. The holding down strip 13 has two distal ends respectively fastened to the partition panel 10 by stitches. The stretcher 2 is a rectangular open frame inserted through the gap between the holding down strip 13 and the bottom panel with two opposite long sides thereof respectively engaged into the pockets 12. Further, each pocket 12 has a snap 14, which is fastened up to secure the stretcher 2 in place after insertion of the two opposite long sides of the stretcher 2 into each of the pockets 12.

Figure 4:
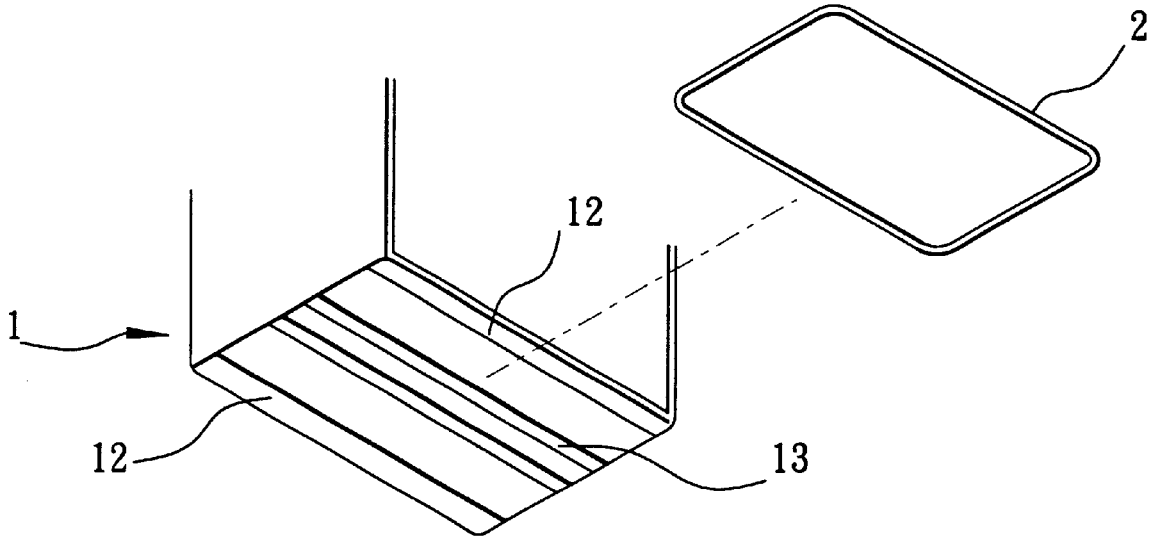
FIG. 4 illustrates the installation of one stretcher in the bottom panel of the wardrobe internal clothes cabinet according to the present invention.

Referring to FIG. 4, the bottom sidewall of the bottom panel of the wardrobe internal clothes cabinet 1 comprises two pockets 12disposed in parallel at two sides and facing each other and two holding down strips 13 are arranged in parallel between the pockets 12, and a respective stretcher 2 is fastened to the pockets 12 to support the bottom panel of the wardrobe internal clothes cabinet 1 in shape. The holding down strips 13 each have two distal ends respectively fastened to the bottom sidewall of the bottom panel of the wardrobe internal clothes cabinet 1 by stitches. The stretcher 2 is inserted through the gap between the holding down strips 13 of the bottom sidewall of the bottom panel of the wardrobe internal clothes cabinet 1 with two opposite long sides respectively engaged into the pocket strips 12.

Figure 3:
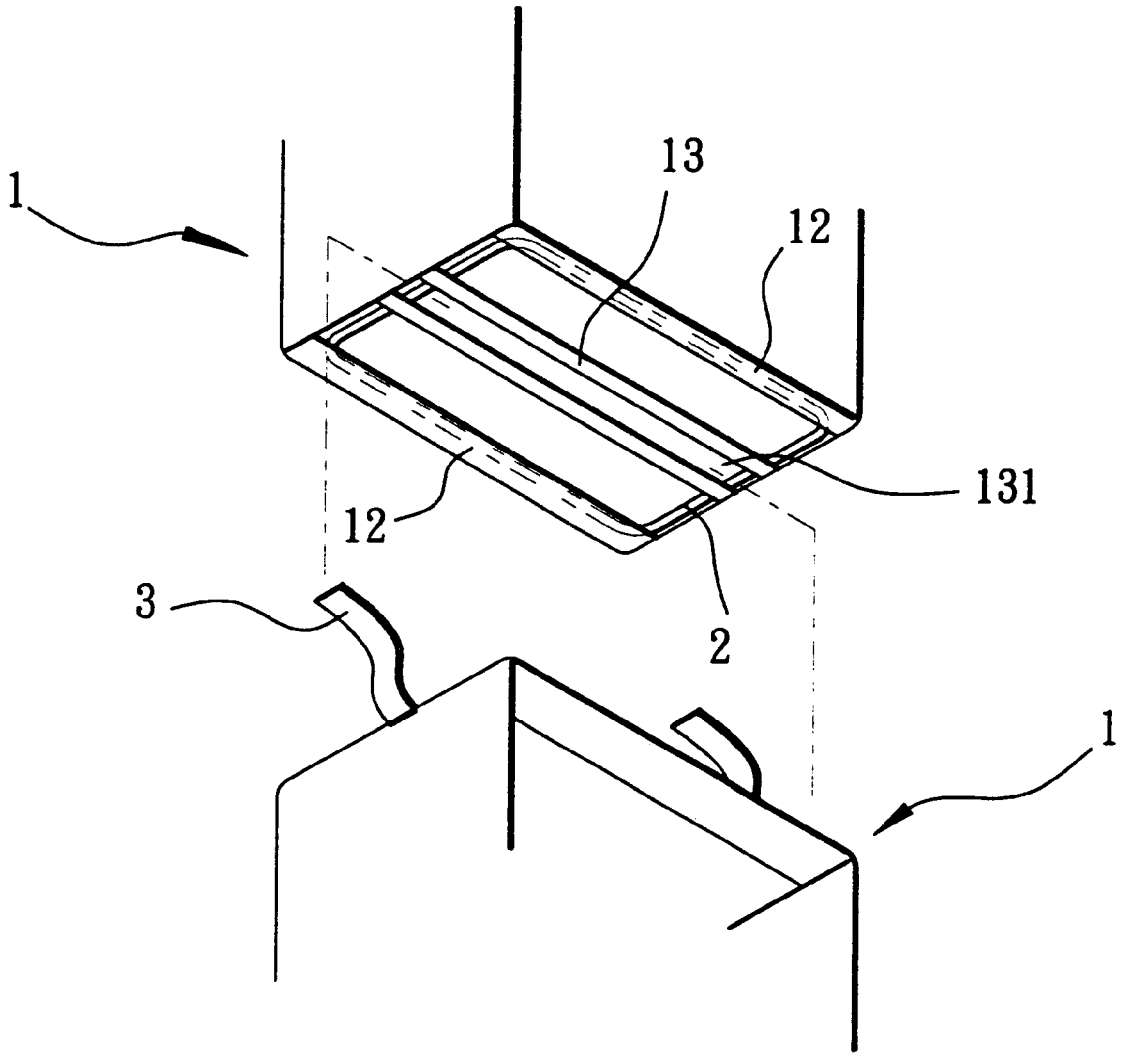
FIG. 3 illustrates the series connection between two wardrobe internal clothes cabinets according to the present invention.

Referring to FIG. 3, two wardrobe internal clothes cabinets 1 can be connected in series. In this case, the fastening devices 3 of the lower wardrobe internal clothes cabinet 1 are respectively inserted through the space 131 between the two holding down strips 13 at the bottom sidewall of the bottom panel of the upper wardrobe internal clothes cabinet 1 and then fastened to the stretcher 2 being attached to the bottom panel of the upper wardrobe internal clothes cabinet 1.

A prototype of wardrobe internal clothes cabinet has been constructed with the features of FIGS. 1~5. The wardrobe internal clothes cabinet functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

It is to be understood that the drawings are designed for purposes of illustration only, and are not intended for use as a definition of the limits and scope of the invention disclosed.

What the invention claimed is:

1. A wardrobe internal clothes cabinet comprising a plurality of partition panels each having two pockets disposed in parallel along two sides of a bottom sidewall of a respective partition panel and facing each other and a holding down strip spaced between said pockets, and a respective stretcher fastened to said pockets to support said partition panel in shape, said holding down strip having two distal ends respectively fastened to said partition panel, said stretcher being a rectangular open frame inserted through a gap between said holding down strip and a bottom panel of said cabinet with two opposite long sides thereof respectively engaged into said pockets, each of said pockets having a snap which is fastened up to secure said stretcher in place after insertion of said two opposite long sides of said stretcher into each of said pockets, and fastening devices being strap members each having a fixed tape of hook material disposed at one end and a fixed tape of loop material disposed at an opposite end for fastening to said fixed tape of hook material.

* * * * *